US006732788B2

(12) United States Patent
Keith et al.

(10) Patent No.: US 6,732,788 B2
(45) Date of Patent: May 11, 2004

(54) VORTICITY GENERATOR FOR IMPROVING HEAT EXCHANGER EFFICIENCY

(75) Inventors: William L. Keith, Ashaway, RI (US); Kimberly M. Cipolla, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 20 days.

(21) Appl. No.: 10/214,530

(22) Filed: Aug. 8, 2002

(65) Prior Publication Data

US 2004/0026069 A1 Feb. 12, 2004

(51) Int. Cl.[7] ..... F28F 13/12

(52) U.S. Cl. ..... 165/109.1; 165/181; 138/38; 29/890.053

(58) Field of Search ..... 165/109.1, 177, 165/178, 181; 138/38; 29/890.053

(56) References Cited

U.S. PATENT DOCUMENTS 3,595,299 A * 7/1971 Weishaupt et al. ..... 159/28.5
4,090,559 A * 5/1978 Megerlin ..... 165/179
4,589,481 A * 5/1986 Mansson ..... 165/172
4,798,241 A * 1/1989 Jarrett et al. ..... 165/109.1
4,881,596 A * 11/1989 Bergmann et al. ..... 165/174
5,497,824 A * 3/1996 Rouf ..... 165/184
6,018,963 A * 2/2000 Itoh et al. ..... 62/527
6,390,183 B2 * 5/2002 Aoyagi et al. ..... 165/146
2002/0139517 A1 * 10/2002 Choi et al. ..... 165/104.26
2002/0195226 A1 * 12/2002 Visser ..... 165/41

FOREIGN PATENT DOCUMENTS

GB 2044430 A * 10/1980 ..... 138/38

* cited by examiner

*Primary Examiner*—Terrell McKinnon
(74) *Attorney, Agent, or Firm*—James M. Kasischke; Michael F. Oglo; Jean-Paul A. Nasser

(57) ABSTRACT

A heat exchange tube includes a tubular conduit for flowing a working fluid therethrough and for conducting heat between the working fluid and a thermal field proximate the tube, and a wire extending axially through the tubular conduit and spaced from an inside surface of the tubular conduit. The invention also provides a method for increasing heat transfer about a tubular conduit by positioning a wire in the conduit.

17 Claims, 3 Drawing Sheets

VORTICITY GENERATOR FOR IMPROVING HEAT EXCHANGER EFFICIENCY

STATEMENT OF GOVERNMENT INTEREST

The invention described herein may be manufactured and used by or for the Government of the United States of America for Governmental purposes without the payment of any royalties thereon or therefor.

CROSS REFERENCE TO OTHER PATENT APPLLICATIONS

Not applicable.

BACKGROUND OF THE INVENTION (1) Field of the Invention

The invention relates to heat exchangers and is directed more particularly to an improvement which renders current heat exchangers more efficient.

(2) Description of the Prior Art

Conventional heat exchangers typically include a tube for flowing a working fluid therethrough, the tube passing through or proximate a thermal medium, hot or cold, to heat or cool the working fluid. The thermal medium may itself be a flowing fluid.

In an effort to improve heat transfer from the thermal medium to the working fluid, in some instances, the outer surface of the tube is increased by the use of external fins or the like. In other instances, a structure is placed in the tube to generate vorticity or turbulence within the tube to increase heat exchange.

For example, in U.S. Pat. No. 4,062,524, issued Dec. 13, 1999 to Dieter Brauner et al, there is disclosed an arrangement of comb-like plates for static mixing of fluids. In U.S. Pat. No. 4,208,136, issued Jun. 17, 1980 to Leonard T. King, there is shown a tube with mixing elements therein, the elements being shaped to impart a rotational vector to portions of the flow stream. In U.S. Pat. Nos. 4,466,741 and 5,312,185, issued Aug. 21, 1984 and May 17, 1994, respectively, to Hisao Kojima, there are shown arrangements of helical blades mounted in tubes. In U.S. Pat. No. 5,518,311, issued May 21, 1996, to Rolf Althaus et al, and in U.S. Pat. No. 5,803,602, issued Sep. 8, 1998, to Adnan Eroglu et al, there are shown triangularly-shaped vortex generators mounted in flow ducts.

The above-noted prior art devices have inherent disadvantages, including pressure drop through the heat exchanger. Helical designs and structures extending widthwise of the tube require increased power input to compensate for friction losses. Further, the relatively large volume of some of the above-noted mixing elements consume much of the cross-section of the tube, reducing the volume available for fluid flow. Still further, the relatively large volume devices result in much heavier tubes.

Accordingly, there is a need for an improved heat exchange tube and system in which heat transfer within a tube conveying a working fluid is substantially enhanced, without adding a substantial volume of blocking structure in the tube or significant weight to the tube, and which does not cause a meaningful pressure drop in the tube, or require further power input to force the fluid therethrough.

SUMMARY OF THE INVENTION

An object of the invention is, therefore, to provide a heat exchange tube featuring structure therein which improves heat transfer, but does not occupy a substantial volume of the tube nor add substantial weight to the tube.

A further object of the invention is to provide such a heat exchange tube in which the internally-mounted structure does not precipitate a meaningful pressure drop in the tube and does not increase resistance to flow such as to require added power to flow the working fluid therethrough.

A further object of the invention is to provide a heat exchange system featuring a tube as described immediately above.

A still further object of the invention is to provide a method for improving heat exchangers, including conventional heat exchangers.

With the above and other objects in view, a feature of the present invention is the provision of a heat exchange tube comprising a tubular conduit for flowing a working fluid therethrough and for conducting heat between the working fluid and a thermal field proximate to the tube, and a wire extending axially through the tube and spaced from an inside surface of the tube.

In accordance with a further feature of the invention, there is provided a heat exchange system including a thermal source providing a fluid heat exchange medium, a heat exchanger for receiving the heat exchange medium, a heat exchange tube extending through the heat exchanger and adapted to flow working fluid therethrough, and a wire extending axially through the tube and spaced from an inside surface of the tube.

In accordance with a still further feature of the invention, there is provided a method for improving heat exchange capacity in a heat exchange tube including a tubular conduit for flowing a working fluid therethrough and for conducting heat between the working fluid and a thermal field proximate the tube, the method comprising providing a wire in the tube extending axially of the tube and spaced from an inside surface of the tube.

The above and other features of the invention, including various novel details of construction and combinations of parts and method steps, will now be more particularly described with reference to the accompanying drawings and pointed out in the claims. It will be understood that the particular devices and method embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent, and wherein corresponding reference characters indicate corresponding parts throughout the several views of the drawings and wherein.

DESCRIPTION OF THE PREFERRED EMBODIMENTS

Figure 1:
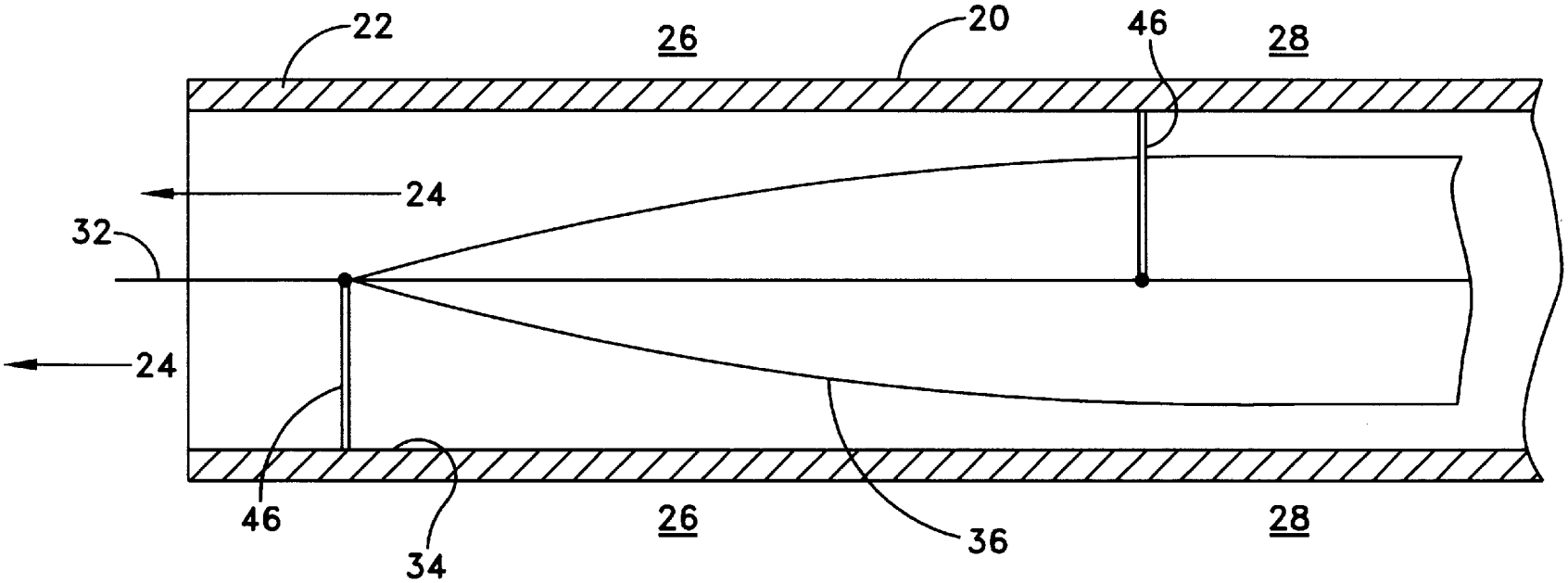
FIG. 1 is a diagrammatic sectional view of one form of heat exchange tube illustrative of an embodiment of the invention.
Figure 2:
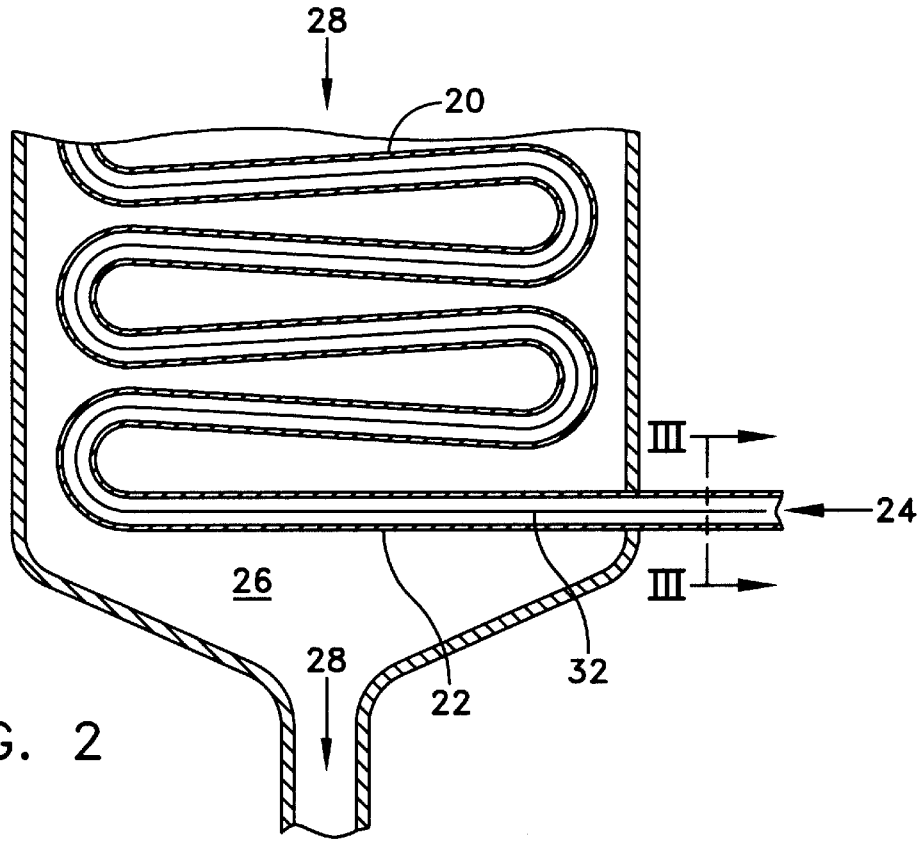
FIG. 2 is a diagrammatic sectional view of the tube of FIG. 1 shown in a heat exchanger.
Figure 3:
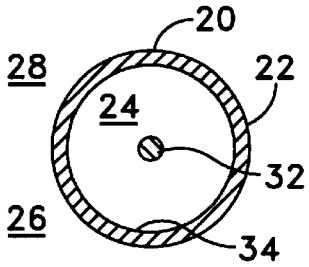
FIG. 3 is a sectional view taken along line III—III of FIG. 2.
Figure 6:
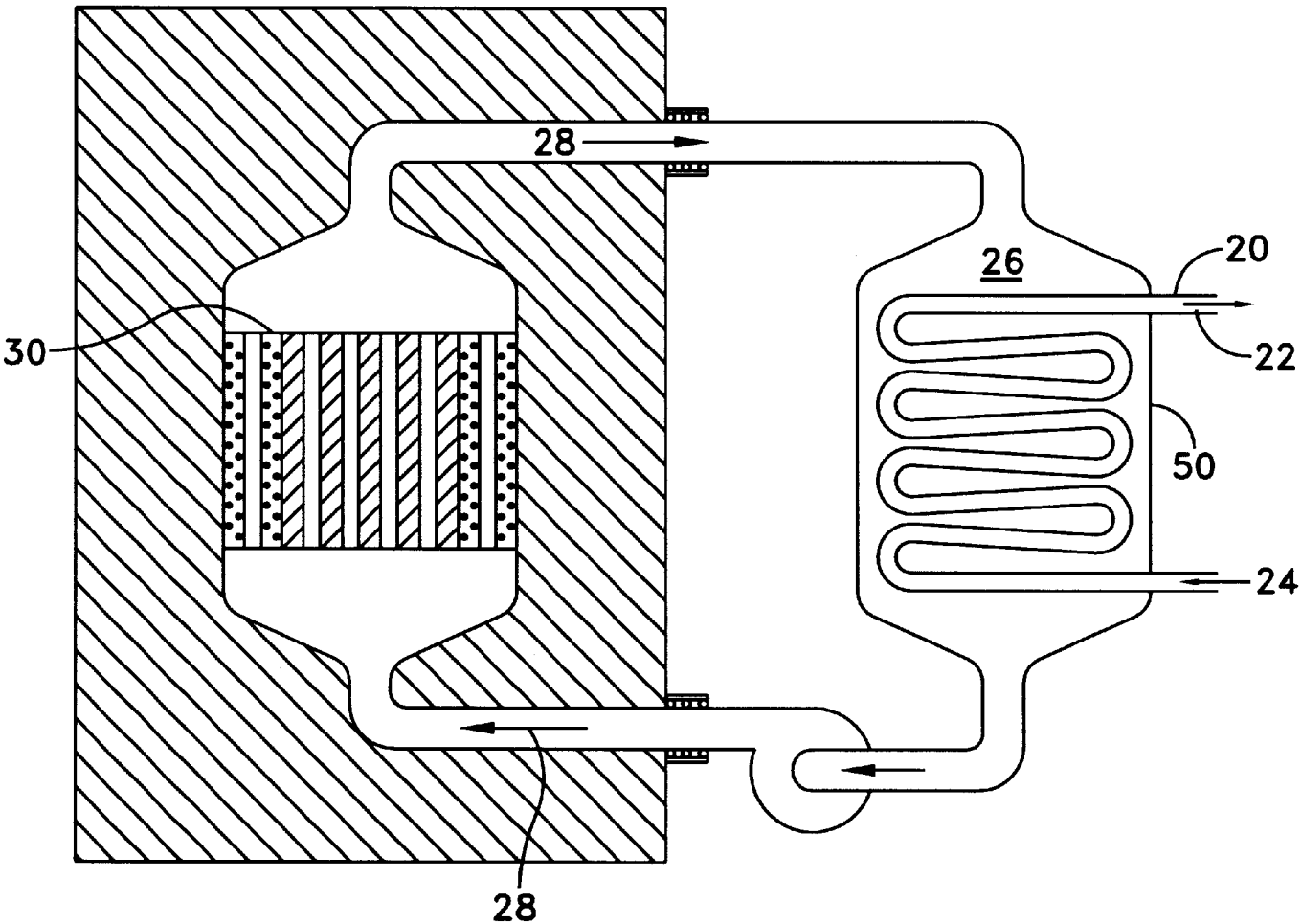
FIG. 6 is a diagrammatic representation of a heat exchange system including the tube of FIGS. 1 and 2 and illustrative of a further embodiment of the invention.

Referring to FIGS. 1—3, it will be seen that an illustrative heat exchange tube 20 includes a tubular conduit 22 for flowing a working fluid 24 therethrough. The tube 20 typically extends through a thermal field 26, such as a fluid heat exchange medium 28 flowing from a thermal source 30 (FIG. 6). The heat exchange meduim 28, or thermal field 26, may be either heated or cooled by the thermal source 30, depending upon whether the working fluid 24 is to gain or lose heat as it passes through the tube 20. Alternately, the thermal source 30 may be a heating or cooling apparatus (not shown) proximate the tube 20 to thermally influence the working fluid 24.

In accordance with the present invention, the above-descrived tube 20 is provided with a thin wire 32 (FIG. 1) extending axially through the tube 20 and spaced form the inside surface 34 of the tube. The wire 32 has been found to create a turbulent boundary layer 36 of axisymmetrical configuration around the wire. The turbulent wall boundary layer 36 on the wire increases mixing of the working fluid in the tube and thereby increases the thermal influence of the thermal field 26 of the working fluid 24.

The wire may be of metal, or temperature resistant plastic, or a composite thereof. The wire 32 is quite thin, in the range of about 0.01–0.1 inch diameter and preferably in the range of about 0.02–0.04 inch diameter, depending in large measure on the diameter of the conduit inside surface 34. If a single wire is used, it preferably is located substantially centrally of the tube 20 and extends axially thereof. However, for specific applications the wire may be placed off-center.

Turbulent flow generation has been experimentally observed using a wire having a diameter as large as 0.08 inches and as small as 0.02 inches in a 2 inch diameter conduit. The largest wire observed reduces the cross sectional area of the conduit by only 0.16%. The effect is expected to be useful for wires occupying as much as 1% of the cross sectional area of a conduit. The lower end of the effect is unknown, but based on the above observations, it extends to wires occupying as little as 0.01% of the cross sectional area of the conduit. Based on the teachings of Incropera and DeWitt, Fundamentals of Heat and Mass Transfer, 2d Edition, at page 399–400, where they discuss flow through a concentric tube annulus, one would not expect a wire having this small a cross sectional area to significantly affect turbulent flow. Thus, the generation of turbulent flow by a member having such a small cross sectional area is unexpected in view of the prior art.

The wire 32 may be mounted by any manner not in contravention of the objects of the invention, that is in any manner not imposing substantial blockage, weight, pressure drops, a need for increased power, and the like. In a preferred embodiment, the wire is fixed to the tops of thin rigid posts 46 extending inwardly from the conduit inside surface 34 (two shown in FIG. 1).

Figure 4:
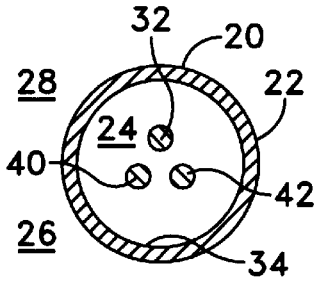
FIG. 4 is a sectional view similar to FIG. 3, but illustrative of an alternative embodiment.
Figure 5:
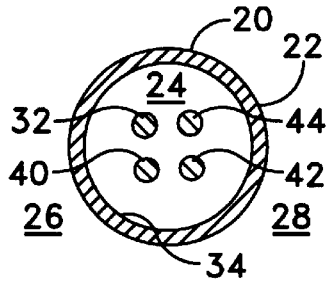
FIGS. 5 and 5A are similar to FIG. 4, but illustrative of further alternative embodiments.
Figure 5A:
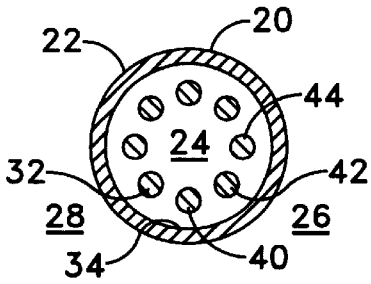

Referring to FIGS. 4 and 5, it will be seen that additional wires 40, 42 (FIG. 4), 44 (FIG. 5) may be used. In such instances, all the wires preferably are spaced from the tube inside surface 34 equidistantly, and spaced from each other. In FIG. 5A there is shown an embodiment for providing maximum turbulence in the boundary layer area of the conduit 22. The wires are disposed in circular fashion around the axis of the conduit and proximate the conduit inside surface 34.

Referring to FIG. 6, it will be seen that an illustrative heat exchange system may include the thermal source 30 which may be either a heat source or a cold source, or a combination thereof. The heat exchange medium 28 flows from the thermal source 30 to a heat exchanger 50 to establish the thermal field 26. The tube 20, carrying the working fluid 24, winds through the heat exchanger 50 and the thermal field 26. The working fluid 24 flows with increased vorticity and mixing, resulting from the boundary layer on the wire, and its interaction with the boundary layer on the tube wall.

While the tube and wire structure may be easily manufactured for new equipment, the wire 32, or any selected number of wires, can be retrofitted into existing heat exchange tubes rather inexpensively and in short time spans.

There is thus provided a heat exchange tube and system which provide for increased heat transfer while not presenting problems related to blockage, weight, pressure drops, or a need for additional power. Further, the invention provides a method for improving the performance of conventional heat exchange tubes, and thereby heat exchange systems.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A heat exchange system comprising:

a thermal source providing a fluid heat exchange medium;

a heat exchanger for receiving the heat exchange medium;

a heat exchange tube extending through said heat exchanger and adapted to flow working fluid therethrough; and a wire extending through said tube and spaced from an inside surface of said tube, said wire having a cross-sectional area small enough relative to said tubular conduit that the cross-sectional area of said combined tubular conduit and wire is substantially the same as that of said tubular conduit.

2. The heat exchange system in accordance with claim 1 wherein the fluid heat exchange medium comprises one of:

a high temperature fluid wherein said heat exchange tube is operative to reduce the high temperature thereof; and a low temperature fluid wherein said heat exchange tube is operative to raise the low temperature thereof.

3. A heat exchange tube comprising:

a tubular conduit for flowing a working fluid therethrough and for conducting heat between the working fluid and a thermal field proximate the tubular conduit; and a wire extending through the tubular conduit and spaced from an inside surface of the tubular conduit, said wire having a cross-sectional area small enough relative to said tubular conduit that the cross-sectional area of said combined tubular conduit and wire is substantially the same as that of said tubular conduit.

4. The heat exchange tube in accordance with claim 3 wherein said wire is of a material selected from metal, temperature resistant plastics, and composites thereof.

5. The heat exchange tube in accordance with claim 3 wherein said wire is disposed substantially centrally and extends substantially axially of said conduit.

6. The heat exchange tube in accordance with claim 3 wherein the thermal field comprises a fluid which flows around the tubular conduit.

7. The heat exchange tube in accordance with claim 6 wherein the thermal field fluid comprises one of a high temperature fluid wherein said heat exchange tube operates to reduce the high temperature thereof, and a low temperature fluid wherein said heat exchange tube operates to raise the low temperature thereof.

8. The heat exchange tube in accordance with claim 3 wherein:

the working fluid is a liquid and said wire forms a turbulent boundary layer of the working fluid around said wire to increase thermal transfer within said tubular conduit, the turbulent boundary layer being of axisymmetrical configuration around said wire; and the thermal field comprises a fluid flowing around said tubular conduit for transferring thermal energy between said tubular conduit and the thermal field fluid.

9. The heat exchange tube in accordance with claim 3 wherein said wire occupies less than 1% of the cross sectional area of said tubular conduit.

10. The heat exchange tube in accordance with claim 9 wherein said wire occupies between 1% and 0.01% of the cross sectional area of said tubular conduit.

11. The heat exchange tube in accordance with claim 3 and further comprising structure in said conduit for supporting said wire.

12. The heat exchange tube in accordance with claim 11 wherein said structure for supporting said wire comprises posts fixed on the inside surface of said conduit and extending inwardly.

13. The heat exchange tube in accordance with claim 12 wherein said wire is mounted on free ends of said posts.

14. A heat exchange tube comprising:

a tubular conduit for flowing a working fluid therethrough and for conducting heat between the working fluid and a thermal field proximate the tubular conduit; and a first wire extending through the tubular conduit and spaced from an inside surface of the tubular conduit; and at least a second wire extending through the tubular conduit and spaced from an inside surface of the tubular conduit and from said first wire.

15. The heat exchange tube in accordance with claim 14 wherein said wires are equidistantly spaced from the inside surface of the tubular conduit.

16. The heat exchange tube in accordance with claim 14 wherein each of said wires is of a material selected from metal, temperature resistant plastics, and composites thereof.

17. A method for improving heat exchange capacity in a heat exchange tube comprising a tubular conduit for flowing a working fluid therethrough and for conducting heat between the working fluid and a thermal field proximate the tube, the method comprising:

providing a wire in the tubular conduit extending axially of the tubular conduit and spaced from an inside surface of the tubular conduit, said wire having a cross-sectional area small enough relative to said tubular conduit that the cross-sectional area of said combined tubular conduit and wire is substantially the same as that of said tubular conduit.

* * * * *